US005980700A

United States Patent [19]

Iritani

[11] Patent Number: 5,980,700

[45] Date of Patent: Nov. 9, 1999

[54] METHOD AND APPARATUS FOR PRODUCING A LOW POLLUTION FUEL

[76] Inventor: Takamasa Iritani, 3-1 Dannoura-cho, Shimonoseki-shi, Yamaguchi-ken, Japan

[21] Appl. No.: 09/027,243

[22] Filed: Feb. 20, 1998

[30] Foreign Application Priority Data

Mar. 24, 1997 [JP] Japan ..... 9-069965

[51] Int. Cl.[6] ..... C07B 63/00

[52] U.S. Cl. ..... 204/157.62; 422/186.01; 422/186.03

[58] Field of Search ..... 204/157.62; 422/169, 422/186, 186.01, 186.03; 44/629, 639, 904

[56] References Cited

U.S. PATENT DOCUMENTS 3,616,375 10/1971 Inoue ..... 204/157.62
4,357,146 11/1982 Hereen ..... 44/56
5,059,217 10/1991 Arroyo ..... 44/639

*Primary Examiner*—Kathryn Gorgos
*Assistant Examiner*—Jonathan Brown
*Attorney, Agent, or Firm*—Nikaido Marmelstein Murray & Oram, LLP.

[57] ABSTRACT

The present invention provides a method of producing a low pollution fuel comprising the steps of passing in an electromagnetic field a synthetic fuel comprising methyl alcohol or ethyl alcohol and butyl alcohol, toluene, and heavy gasoline, subjecting the synthetic fuel to supersonic wave vibration, and having the synthetic fuel pass in contact with a predetermined inorganic substance. There is also provided an apparatus for producing a low pollution fuel which comprises a synthetic fuel introducing path, magnetic field generating means for generating a magnetic field, supersonic generating means, and inorganic substance, a synthetic fuel contact path for passing a synthetic fuel in contact with the inorganic substance, a synthetic fuel discharge path, and means for sending out the synthetic fuel.

6 Claims, 4 Drawing Sheets

METHOD AND APPARATUS FOR PRODUCING A LOW POLLUTION FUEL

FIELD OF THE INVENTION

This invention relates to a method and apparatus for producing a low pollution fuel which can be used as an alternate fuel for an internal combustion engine and other industrial engines.

BACKGROUND OF THE INVENTION

A limited petroleum fuel, particularly gasoline is widely used for an internal combustion engine and other industrial engines. However, the petroleum fuel of this kind is disadvantageous in the fact that harmful gases such as carbon oxides($CO_X$), volatile hydrocarbon ($H_XC_Y$), sulfur oxides ($SO_X$) and nitrogen oxides ($NO_X$) are exhausted, when the fuel is subjected to combustion.

Accordingly, an alternate fuel, for example, a methanol or ethanol containing fuel has been developed to reduce harmful gaseous emissions, and recently utilized for a low pollution car and industrial engines. Methanol fuel can contribute to the reduction of air pollution caused by gaseous emissions. However, when methanol fuel is used in, for example, the internal combustion engine mounted in a motor-car, it is difficult that an inherent heat efficiency of the internal combustion engine is maintained, since a heating value of the methanol fuel is about 50% of the heating value of gasoline. Accordingly, a travel distance of the motor-car using this fuel is reduced to about 50%. In addition, methanol fuel is associated with another problem that it may require a whole modification, or a completely new design of the internal combustion engine for efficient combustion of the fuel.

Ethanol fuel can also contribute to the reduction of air-pollution in the same manner as methanol fuel. However, it has a lower stream pressure. That is, when the fuel of 100% ethanol is used for the internal combustion engine of the motor-car, the motor-car cannot smoothly be started. In addition, since ethanol is also a limited substance, it is difficult to supply a sufficient amount of ethanol for this application in a constant manner. This is also a serious problem.

Therefore, it is an object of the present invention to provide a method and apparatus for producing a low-pollution fuel including alcohol as a main component, which can contribute to the reduction of air-pollution.

It is another object of the present invention to provide a method and apparatus for producing a low-pollution fuel including alcohol as a main component, which can sufficiently be supplied to the market.

It is still another object of the present invention to provide a method and apparatus for producing a low-pollution fuel composition including alcohol as a main component, which can exhibit a heat value substantially equal to gasoline, and which enables a gasoline motor-car to run substantially the same distance as in the case that the motor-car uses without any major modification of an internal combustion engine mounted therein.

SUMMARY OF THE INVENTION

In the present invention, in order to solve the problems as described above, an entirely new method of producing a low pollution fuel having alcohol as a main component and an apparatus for producing such fuel have been developed, and the following technical means have been provided.

As a primary means thereof, the present invention provides, through the process of passing a synthetic fuel comprising methyl alcohol or ethyl alcohol and butyl alcohol, toluene, and heavy gasoline in a magnetic field, a process of subjecting the synthetic fuel which has passed in the magnetic field to supersonic vibration, and a process of having the synthetic fuel which has been subjected to supersonic vibration pass in contact with a predetermined inorganic substance, there are formed a large amount of foams in the synthetic fuel with suppression of generation of the exhaust gas such as $CO_X$, $H_XO_Y$, $SO_X$, $NO_X$, etc. in combustion, by which vigorous molecular movements are induced in the particles of synthetic fuel forming clusters to decompose the clusters, thereby making it possible to activate the synthetic fuel. In addition, ionization of the synthetic fuel activated by the catalytic action of the inorganic substance is induced to make the clusters smaller, by which combustion efficiency of synthetic fuel can be simply improved. Moreover, by minimizing the clusters, there can be obtained an advantage of suppressing the oxidation of the synthetic fuel.

BRIEF DESCRIPTION OF THE DRAWINGS

The above, and other objects, features and advantages of the present invention will become apparent from the detailed description thereof read in conjunction with the accompanying drawings wherein.

DETAILED DESCRIPTION OF THE PREFERRED EMBODIMENTS

First Embodiment

Figure 1:
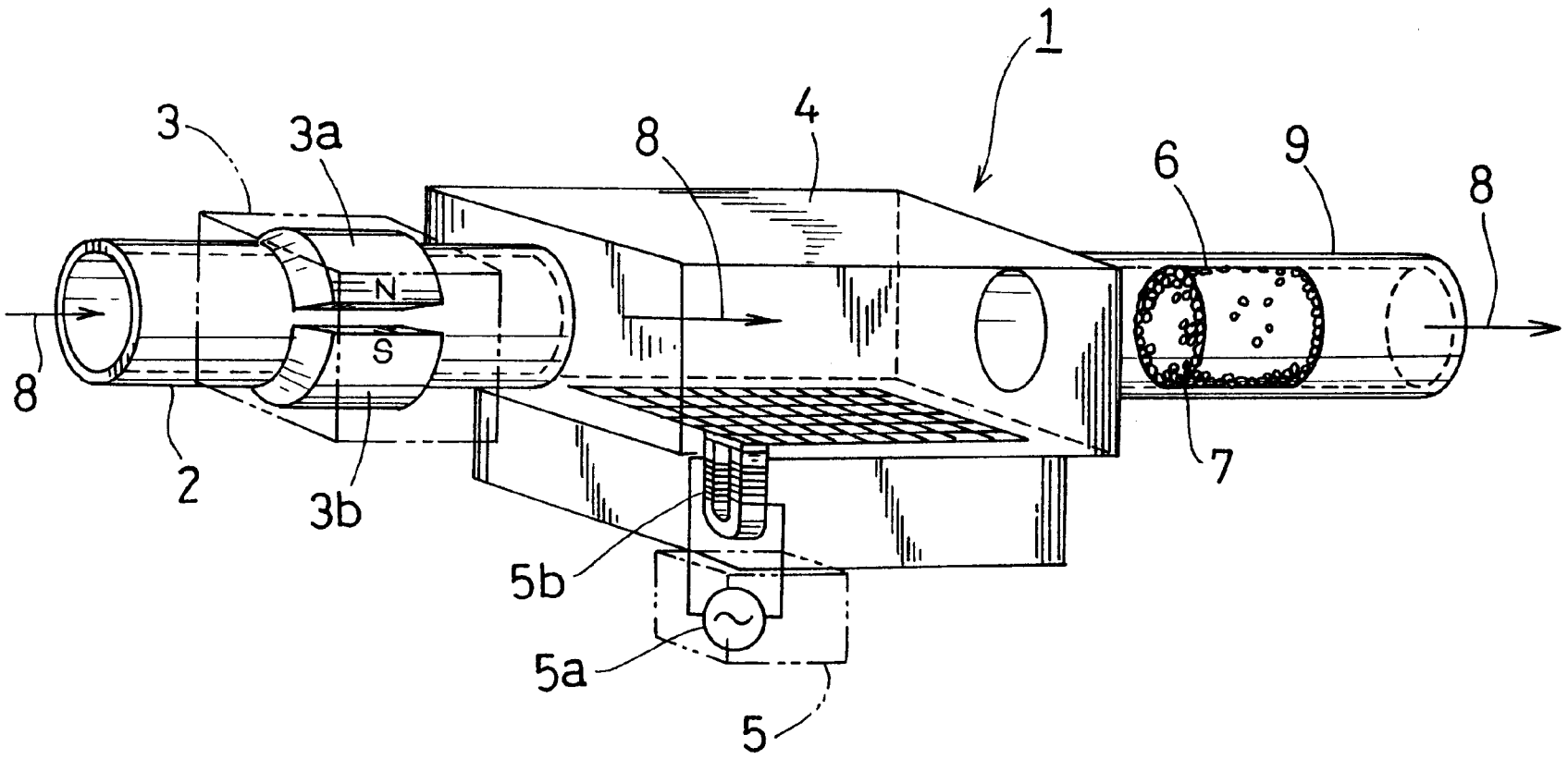
FIG. 1 is a perspective view of an apparatus for practicing the method of producing a low pollution fuel of the present invention.

Hereinafter, the first embodiment of the production apparatus for practicing a method of producing a low pollution fuel in the present invention will be explained. Prior to it, explanation will be given on a synthetic fuel to be used for the apparatus.

The synthetic fuel includes the composition rates of 35–45% by weight of methyl alcohol, 3–6% by weight of butyl alcohol, 6–10% by weight of toluene, and 29–39% by weight of heavy gasoline.

Next, there were made the comparative measurements on the CO value, HC value, and $NO_X$ value contained in the exhaust gas by combusting the synthetic fuel having the above mixing rates of the compositions and the gasoline in general commercialization. (Measurements were made in Honda Giken Kogyo Fukuoka Branch)

The results are shown in Table 1 below.

For the experiment, a motor car to be normally used at the time of the vehicle inspection (displacement 2000 cc) was used, and measurements were conducted on the CO value, HC value, and $NO_X$ value as specified in Articles 30 and 31 of Japanese Security Standards Law.

TABLE 1

Comparison of Exhaust Gas Generation Amounts

| | CO value | HC value | $NO_x$ value |
|---|---|---|---|
| Synthetic fuel of the present invention | 0.02% by weight | 10 ppm | 1,800–2,000 ppm |
| Generally commercialized S-maker's gasoline | 4.50% by weight | 1,200 ppm | 2,000–2,200 ppm |

| | Car-A | Car-B |
|---|---|---|
| Engine revolution number (RPM) | 752 | 753 |
| Vehicle speed (km/h) | 0 | 0 |
| Water temperature sensor (° C.) | 94 | 98 |
| Intake air temperature sensor (° C.) | 64 | 66 |
| Intake air pressure sensor (mmHg) | 240 | 273 |
| Throttle aperture sensor (%) | −0.6 | −0.6 |
| $O_2$ sensor (V) | 0.72 | 0.12 |
| $O_2$ feed back | CLOSED | OPEN |
| Battery voltage (V) | 14.4 | 14.3 |
| ELD (A) | 8.6 | 17.0 |
| AC generator (%) | 42 | 48 |
| ACG control (V) | 14.5 | 14.5 |
| Brake SW | OFF | OFF |
| A/C SW | OFF | OFF |
| Injector (ms) | 2.54 | 2.67 |
| EACV (mA) | 316 | 338 |

*For measurement of $NO_x$ value, "10-mode method" is followed.
*The above numerical values are the measured values under the following conditions.

Further, using a synthetic fuel having the above mixing ratio of the compositions and gasoline of generally commercialized petroleum fuel, with the engine revolutions and the load kept constant, measurements were made on the fuel consumption and exhaust gas. (Measurements were made in Musashi Industrial University)

TABLE 2

Comparison of $NO_x$ and fuel consumption

| | Consumption time | $NO_x$ value |
|---|---|---|
| Synthetic fuel of present invention | 37.20 min. | 1,900–2,000 ppm |
| Generally commercialized S-maker's gasoline | 37.00 min. | 2,100–2.200 ppm |

*Experiment method:
1. Method of measuring combustion: Consumption time of 50 cc fuel was measured with a stop watch
2. Method of measuring $NO_x$: With the engine revolution number and loaded weight (torque) kept constant, fuel was changed to carry out measurements
*Experiment conditions: Water temperature: 80° C. Revolution number: 2,000 rpm/min. Load: 1/2 Load 8 kg/f Ps = 16.16

As is apparent from the respective tables given above, the CO value, HC value, and $NO_X$ value in the synthetic fuel of the present invention are all on the low level, and especially in HC, the value is shown to be remarkably low.

Accordingly, when the synthetic fuel of the present invention is used, the amounts of $CO_X$, $H_XC_Y$, $SO_X$, $NO_X$, etc., to be discharged in use decrease, and the fuel can be used as almost pollution-free fuel that never provides a cause for contaminating environmental atmosphere.

The synthetic fuel used for the above fuel combustion experiment has its composition mixing rate as 35–45% by weight of methyl alcohol, 3–6% by weight of butyl alcohol, 6–10% by weight of toluene, and 29–39% by weight of heavy gasoline. However, the composition mixing rate may be 25–60% by weight of methyl alcohol, 10–25% by weight of butyl alcohol, 20–50% by weight of toluene, and 20–50% by weight of heavy gasoline. Alternatively, in case the composition mixing rate may be 25–60% by weight of ethyl alcohol, 10–25% by weight of butyl alcohol, 20–50% by weight of toluene, and 20–50% by weight of heavy gasoline, the amounts of the $CO_X$, $H_XC_Y$, $SO_X$, $NO_X$, etc. remarkably decrease. Preferably, the mixing proportion is 35–45% by weight of methyl alcohol, 3–6% by weight of butyl alcohol, 6–10% by weight of toluene, and 29–39% by weight of heavy gasoline. A preferable result can also be obtained when isobutyl alcohol is used instead of butyl alcohol in the same percentage by weight as that of butyl alcohol. In this case, the most preferable composition mixing rate is 45% by weight of methyl alcohol, 6% by weight of isobutyl alcohol, 10% by weight of toluene, 39% by weight of heavy gasoline.

As described above, in the synthetic fuel of the present invention, the weight ratio of the alcohol component including methyl alcohol or ethyl alcohol and butyl alcohol to toluene, heavy gasoline, and other composition is 3:1–1:3, preferably 1:1.5–1.5:1. When the proportion of the toluene, heavy gasoline, and other components is less than ⅓ of the alcohol components, heating value is lowered. On the contrary, when the proportion of the toluene, heavy gasoline and other components is more than three times of the alcohol components, the contents of the $CO_X$, $H_XC_Y$, $SO_X$, $NO_X$, etc. increase, and such cannot be termed as preferred composition rate.

Furthermore, in the present invention, there can be produced a synthetic fuel comprising methyl alcohol or ethyl alcohol and butyl alcohol, toluene, and heavy gasoline, being a low pollution fuel having further improved combustion efficiency.

In FIG. 1, the numeral 1 shows an apparatus for producing a low pollution fuel. The apparatus 1 includes a pipe shaped synthetic fuel introducing path 23 having a magnetic field generating apparatus (magnetic field generating means) 3 provided with at least a pair of opposed N-pole 3*a* and S-pole 3*b* so as to allow the synthetic fuel 8 introduced from a predetermined part (not illustrated) to pass through the magnetic field orthogonally; a supersonic bath 4 having at the bottom a supersonic generating apparatus (supersonic generating means) 5 including a high frequency oscillator 5*a* and a high frequency vibrator 5*b* which are designed to subject the synthetic fuel 8 which has passed through the magnetic field in the synthetic fuel introducing path 2 to supersonic vibration; and a pipe-shaped synthetic fuel contact path 6 having in the flow path an inorganic substance 7 constituted by tourmaline ore and basalt, polar crystals, so as to bring the synthetic fuel 8, which has been oscillated by supersonic wave in the supersonic wave bath 4, into contact with the inorganic substance 7, and a synthetic fuel discharge path 9.

Accordingly, when the apparatus 1 is used, large amount of foams are generated to form clusters through the magnetic field generating apparatus 3 and supersonic generating apparatus 5 in the synthetic fuel 8 with suppression of generation of the exhaust gas such as $CO_X$, $H_XO_Y$, $SO_X$, $NO_X$, etc. in combustion, by which vigorous molecular movements are caused to the particles of synthetic fuel 8 forming clusters to decompose the clusters, thereby activating the synthetic fuel. In addition, due to the catalytic activity of the inorganic substance 7, i.e., when the tourmaline ore comes into contact with the synthetic fuel 8, electric discharge occurs instantaneously, by which the surrounding fuel is electrically decomposed and combined with the electrons discharged through the electric decomposition and neutralized to form hydrogen atoms, with the result that the hydrogen molecules in the synthetic fuel are increased to make it possible to improve the combustion efficiency of the synthetic fuel 8 in a simple manner. In addition, by minimizing the clusters, oxidation of the synthetic fuel 8 can be suppressed, and consequently it becomes possible to extend a series of the sustaining period of the above effects to about one and half a month.

Second Embodiment

Figure 2:
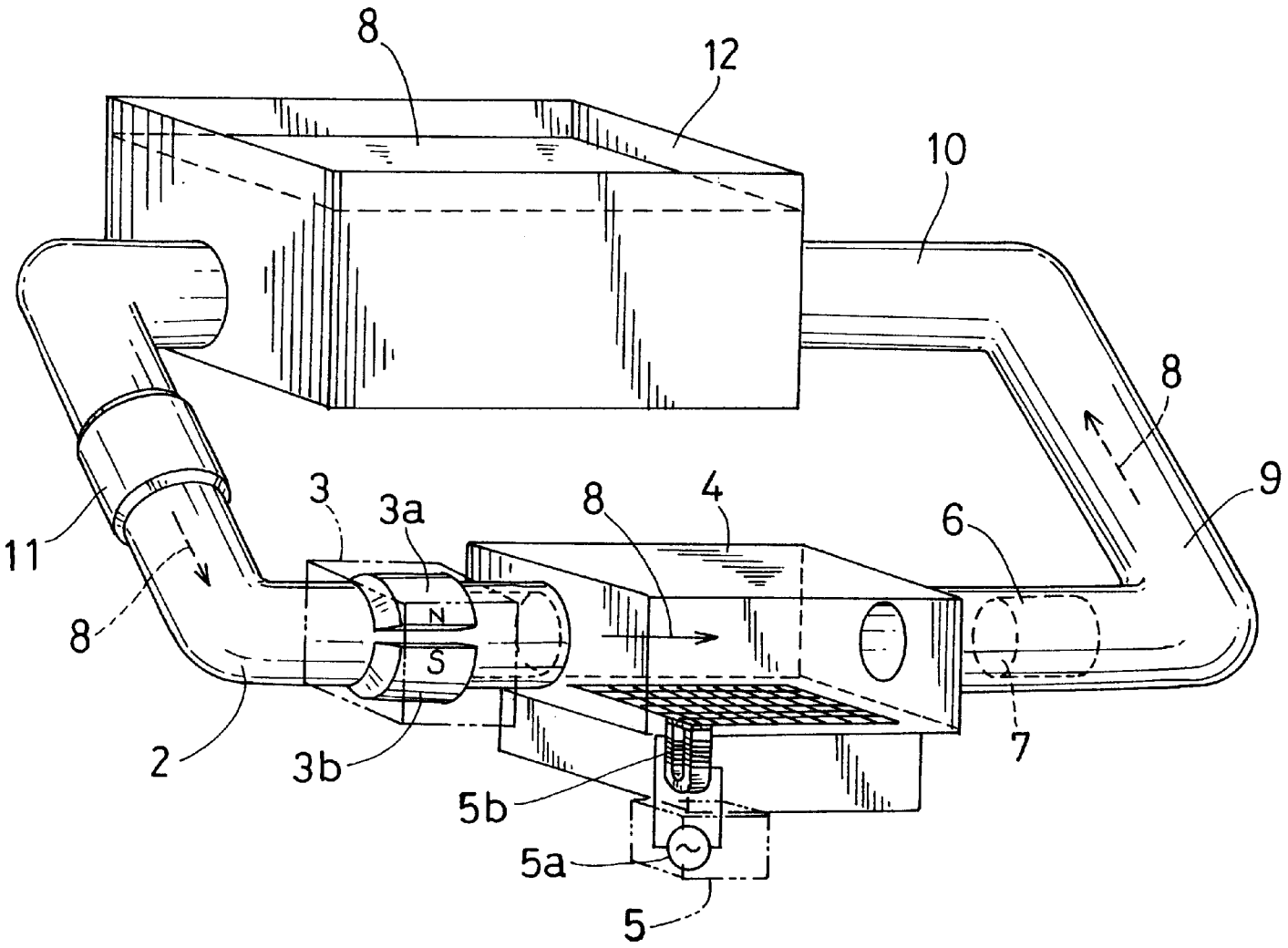
FIG. 2 is a perspective view illustrating another embodiment of the apparatus for practicing the method of producing the low pollution fuel of the present invention.

Furthermore, the arrangement may be such that, as shown in FIG. 2, the synthetic fuel introducing path 2, the synthetic fuel contact path 6, and the synthetic fuel discharge path 9 of the apparatus having the above arrangement are provided in a circulation path 10 having a fuel storage tank 12 which can store a predetermined amount of the synthetic fuel 8, so that the synthetic fuel 8 is sequentially circulated in repetition through a pump (means for sending out the synthetic fuel) 11 provided in the circulation path 10. In such a case, through the process of sequentially repeating the process of passing the synthetic fuel 8 in the magnetic field, the process of subjecting the synthetic fuel 8 which has been passed in the magnetic field to supersonic vibration, the process of passing the supersonically vibrated synthetic fuel 8 in contact with a predetermined inorganic substance, and the process of storing the synthetic fuel 8 which has been passed in contact with the inorganic substance, generation of the exhaust gas such as $CO_X$, $H_XO_Y$, $SO_X$, $NO_X$, etc. in combustion is suppressed, and large amount of foams are generated in the synthetic fuel 8 to form clusters, through which vigorous molecular movements are caused to the particles of synthetic fuel 8 to decompose said clusters, thereby activating the synthetic fuel 8. In addition, ionization of the synthetic fuel 8 activated by the catalytic activity of the inorganic substance 7 is accelerated, by which the clusters are further minimized to improve the combustion efficiency of the synthetic fuel 8 in a simple manner. Moreover, by minimizing clusters, oxidation of the synthetic fuel 8 can also be suppressed. And further, by repeating a series of the above processes, the clusters are decomposed until the molecular movements reach the maximum level, and while further improving the combustion efficiency of the synthetic fuel 8, a series of the sustaining period of the above effects can be extended to about two and half months.

Third Embodiment

Figure 3:
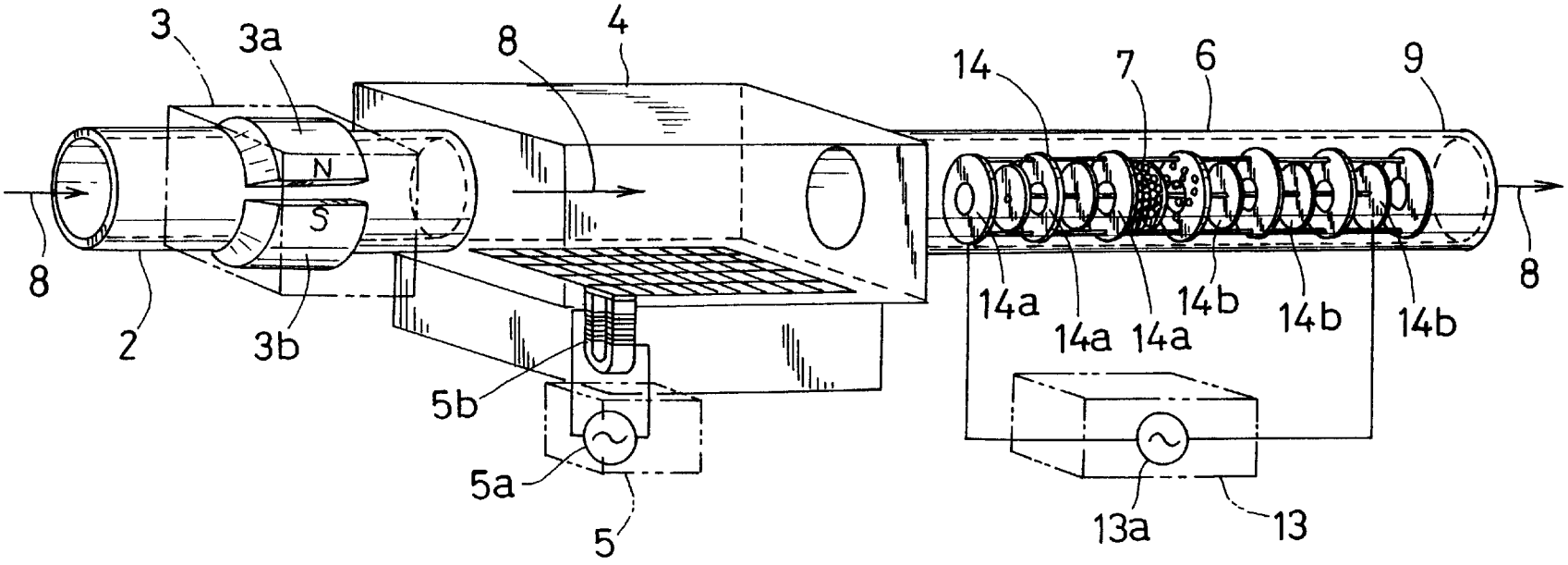
FIG. 3 is a perspective view illustrating still another embodiment of the apparatus for practicing the method of producing the low pollution fuel of the present invention.
Figure 4:
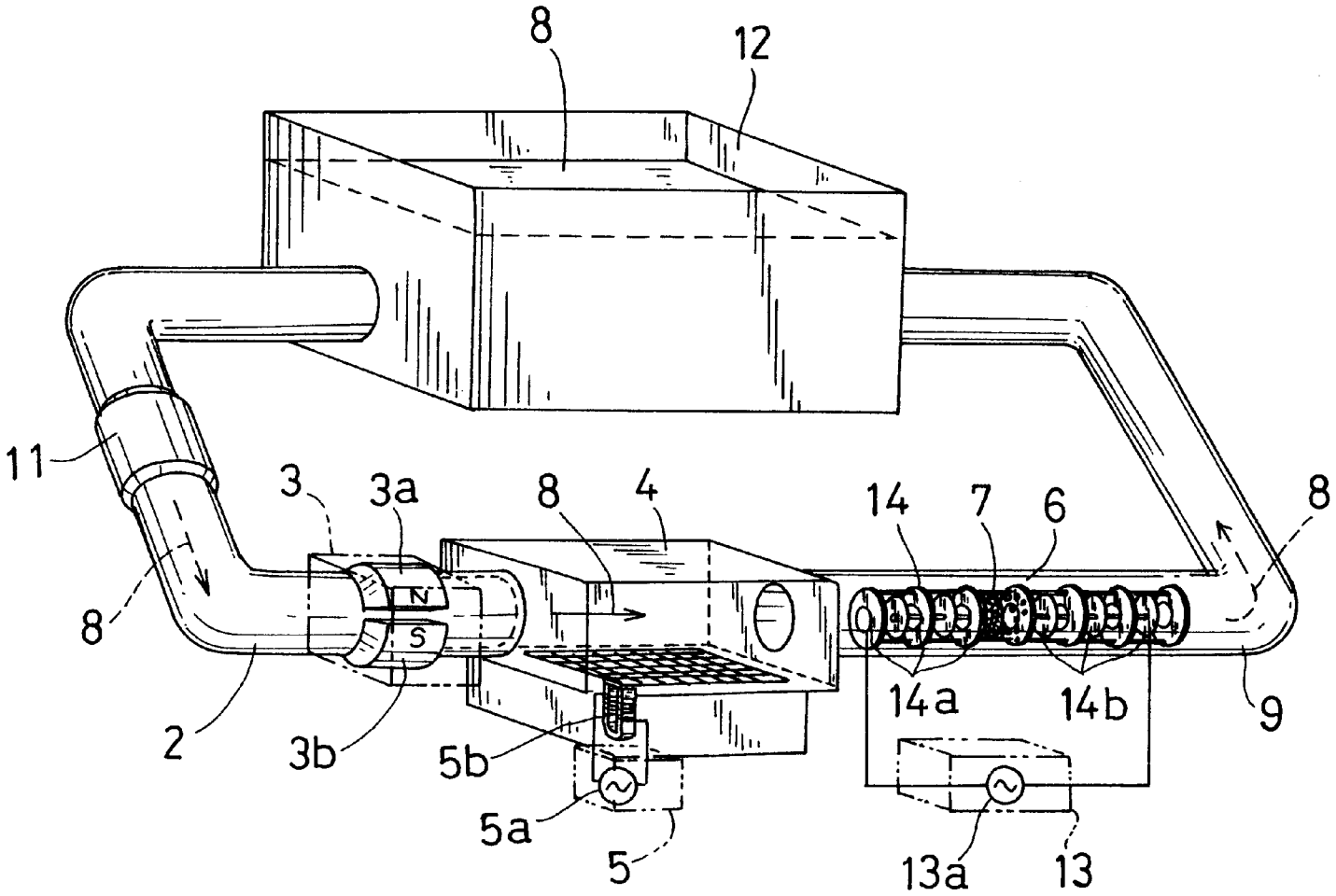
FIG. 4 is a perspective view illustrating another embodiment of the apparatus for practicing the method of producing the low pollution fuel of the present invention.

Furthermore, there may be provided in the synthetic fuel contact path 6 of the apparatus used in the First Embodiment, as shown in FIG. 3, an electrode 14 including a plurality of ring shaped electrodes 14*a* connected in multiplex stages at a predetermined interval so as to make a through-hole provided at the center a flow path for the synthetic fuel 8 and a plurality of the disk shaped electrodes 14*b* connected in multiplex stages at a predetermined interval so as to be individually positioned between the ring shaped electrodes 14*a*, and the inorganic substance 7 are respectively stored and positioned at a predetermined position of said electrode 14. Also, there may be provided on the apparatus 1 a high frequency high voltage generating apparatus 13 having a high frequency high voltage generator 13*a* to apply high frequency high voltage to said electrode 14, i.e., to the ring shaped electrode 14*a* and disk shaped electrode 14*b*. In such a case, through the process of passing the synthetic fuel 8 in the magnetic field, the process of subjecting the synthetic fuel 8 which has been passed in the magnetic field to supersonic vibration, the process of passing the supersonically vibrated synthetic fuel 8 in contact with a predetermined inorganic substance, and the process of applying a high frequency high voltage to the synthetic fuel 8 which has been passed in contact with the inorganic substance, generation of the exhaust gas such as $CO_X$, $H_XO_Y$, $SO_X$, $NO_X$, etc., in combustion is suppressed, and large amount of foams are generated in the synthetic fuel 8 to form clusters, through which vigorous molecular movements are caused to the particles of synthetic fuel 8 to decompose said clusters, thereby activating the synthetic fuel 8. In addition, ionization of the synthetic fuel 8 activated by the catalytic activity of the inorganic substance is accelerated, by which the clusters are further minimized to improve simply the combustion efficiency of the synthetic fuel 8. Moreover, by minimizing clusters, oxidation of the synthetic fuel 8 can also be suppressed. And further, by the destruction of the foams through the high frequency high voltage, the synthetic fuel 8 is brought to a high temperature and high pressure condition, under which Brown's movements are induced, thereby minimizing the molecular group of hydrocarbon and accelerate further the explosive force. In addition, there is an advantage that a series of the sustaining period of the above effects can be extended to about three to four months.

Fourth Embodiment

Furthermore, the arrangement may be such that, in the circulating path 10 having the fuel storage tank 12 capable of storing a predetermined amount of the synthetic fuel 8, there are provided the synthetic fuel introducing path 2 of the apparatus used in the Third Embodiment, the synthetic fuel connecting path 6 and the synthetic fuel discharge path 9, so that the synthetic fuel 8 is sequentially circulated in repetition through the pump (means for sending out the synthetic fuel) 11 provided in the circulating path 10. In such a case, through the process of sequentially repeating the process of passing the synthetic fuel 8 in the magnetic field, the process of subjecting the synthetic fuel 8 which has been passed in the magnetic field to supersonic vibration, the process of passing the supersonically vibrated synthetic fuel 8 in contact with a predetermined inorganic substance, the process of applying a high frequency high voltage to the synthetic fuel 8 which has passed in contact with the inorganic substance, and the process of storing the synthetic fuel 8 to which a high frequency high voltage has been applied, generation of the exhaust gas such as $CO_X$, $H_XO_Y$, $SO_X$, and $NO_X$ in combustion is suppressed, and large amount of foams are generated in the synthetic fuel 8 to form clusters, through which vigorous molecular movements are caused to the particles of synthetic fuel 8 to decompose the clusters, thereby activating the synthetic fuel 8. In addition, ionization of the synthetic fuel 8 activated by the catalytic activity of the inorganic substance is accelerated, by which the clusters are further minimized to improve the combustion efficiency of the synthetic fuel 8 in a simple manner. Moreover, by minimizing clusters, oxidation of the synthetic fuel 8 can also be suppressed. And further, by the destruction of the foams through the high frequency high voltage, the synthetic fuel 8 is brought to a high temperature and high pressure condition, under which Brown's movements are induced, thereby minimizing the molecular group of hydrocarbon and accelerate further the explosive force. In addition, there is an advantage that a series of the sustaining period of the above effects can be extended to about six months.

Accordingly, by using the apparatus described in each embodiment above, it is possible to provide a low pollution fuel which is applicable to the conventional internal combustion engine for gasoline without modification, which can be produced at reduced cost, whose production process is easy and whose material supply is stabilized, which is practical, and shows improved combustion efficiency.

In the embodiments given above, the inorganic substance used includes a tourmaline ore and basalt. The materials are not limited to them but optional combination of tourmaline ore, ferromagnetic ore, basalt, andesite, zeolite, etc. may be employed. For example, tourmaline ore is a dielectric, i.e., "polar crystal", which shows instantaneously electric discharge when brought into contact with a synthetic fuel. As a result, the ambient fuel shows electrolysis, and is combined with the electrons discharged through the electrolysis and neutralized to become hydrogen atom, and as a result it can serve to increase the combustion efficiency by increasing the hydrogen molecules in the synthetic fuel. Further, the ferromagnetic ore induces ionization. When the synthetic fuel is brought into contact with the ferromagnetic ore together with the tourmaline ore, the clusters are further minimized to increase the calorie of fuel in combustion.

Furthermore, the low pollution fuel according to the present invention is not limited to the one given in the embodiments described above. Of course, the synthetic fuel of the present invention may be used by mixing with the petroleum fuel in general use such as gasoline. Even in such case, the CO value, HC value, and $NO_X$ value in the exhaust gas are extremely low, and there can be provided a low pollution fuel with further improved combustion efficiency.

Furthermore, in each embodiment above, the apparatus for producing the low pollution fuel includes the magnetic field generating apparatus having at least a pair of opposed N-pole and S-pole so as to have the introduced synthetic fuel pass through the magnetic field orthogonally. The medium to be employed is not limited to the electromagnet but a permanent magnet, insofar as it generates a strong magnetic field. Needless to say, a specific structure, quantity, fixing place, etc. of the magnetic field generating means are never to be limited, provided that there is one which generates a magnetic field and allows passage of the above synthetic fuel in the magnetic field.

Furthermore, in each of the above embodiments, the apparatus for producing the low pollution fuel includes the supersonic bath having at the bottom the supersonic wave generating apparatus including a high frequency oscillator and a high frequency vibrator which are designed to subject the synthetic fuel which has passed through the magnetic field in the synthetic fuel introducing path to supersonic vibration. In short, a specific structure or kind of the supersonic wave generating means is not limited if there is provided supersonic wave generating means for subjecting the synthetic fuel which has passed through the magnetic field to supersonic vibration.

This specification is by no means intended to restrict the present invention to the preferred embodiments set forth therein. Various modifications to the method and apparatus for producing the low pollution fuel, as described herein, may be made by those skilled in the art without departing from the spirit and scope of the present invention as defined in the appended claims.

What is claimed is:

1. A method of producing a low pollution fuel comprising the steps of:

passing in an electromagnetic field a synthetic fuel comprising methyl alcohol or ethyl alcohol and butyl alcohol, toluene, and heavy gasoline;

subjecting said synthetic fuel to supersonic wave vibration;

having said synthetic fuel pass in contact with a predetermined inorganic substance; and applying high frequency high voltage to said synthetic fuel passing through said predetermined inorganic substance in contact.

2. A method of producing a low pollution fuel according to claim 1, wherein the weight ratio of said methyl alcohol or ethyl alcohol and butyl alcohol to toluene, heavy gasoline, and other composition is 3:1–1:3.

3. A method of producing a low pollution fuel comprising the steps of passing in an electromagnetic field a synthetic fuel comprising methyl alcohol or ethyl alcohol and butyl alcohol, toluene, and heavy gasoline;

subjecting said synthetic fuel to supersonic vibration;

having said synthetic fuel pass in contact with a predetermined inorganic substance;

applying high frequency high voltage to said synthetic fuel passing through said predetermined inorganic substance in contact; and storing said synthetic fuel which has been passed in contact with said predetermined inorganic substance.

4. A method of producing a low pollution fuel according to claim 3, wherein the weight ratio of said methyl alcohol or ethyl alcohol and butyl alcohol to toluene, heavy gasoline, and other composition is 3:1–1:3.

5. An apparatus for producing a low pollution fuel comprising a synthetic fuel introducing path, magnetic field generating means for generating a magnetic field, supersonic generating means an inorganic substance, a synthetic fuel Contact path for passing a synthetic fuel in contact with said inorganic substance, a synthetic fuel discharge path, means for sending out said synthetic fuel, a high frequency generating device and an electrode part mounted in said high frequency generating device, said electrode part being provided therein with said inorganic substance, in which said electrode part is set in position in said synthetic fuel contact path.

6. An apparatus for producing a low pollution fuel according to claim 5, wherein said synthetic fuel introducing path, said synthetic fuel contact path, and said synthetic fuel discharge path are provided in a circulation path, and a fuel storage tank is provided between said synthetic fuel discharge path and said synthetic fuel introducing path.

* * * * *